US009856721B2

(12) United States Patent
Reid et al.

(10) Patent No.: US 9,856,721 B2
(45) Date of Patent: Jan. 2, 2018

(54) APPARATUS AND METHOD FOR INJECTING A CHEMICAL TO FACILITATE OPERATION OF A SUBMERSIBLE WELL PUMP

(71) Applicant: Baker Hughes Incorporated, Houston, TX (US)

(72) Inventors: Leslie C. Reid, Coweta, OK (US); Jordan Kirk, Broken Arrow, OK (US); Brian W. Messer, Broken Arrow, OK (US); Gary L. Allred, Stroud, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 299 days.

(21) Appl. No.: 14/681,586

(22) Filed: Apr. 8, 2015

(65) Prior Publication Data

US 2016/0298631 A1 Oct. 13, 2016

(51) Int. Cl.

| | |
|---|---|
| ***E21B 43/12*** | (2006.01) |
| ***F04D 13/10*** | (2006.01) |
| ***F04D 15/00*** | (2006.01) |

(52) U.S. Cl.

CPC ..... *E21B 43/128* (2013.01); *F04D 13/10* (2013.01); *F04D 15/0077* (2013.01)

(58) Field of Classification Search

CPC ..... E21B 43/121; E21B 43/128

See application file for complete search history.

(56) References Cited

U.S. PATENT DOCUMENTS

| | | | | |
|---|---|---|---|---|
| 4,187,912 | A * | 2/1980 | Cramer | E21B 43/121 166/107 |
| 4,479,759 | A * | 10/1984 | Zeitz | F04B 7/06 417/500 |
| 4,505,155 | A * | 3/1985 | Jackson | E21B 17/003 73/152.18 |
| 4,582,131 | A * | 4/1986 | Plummer | E21B 37/06 166/310 |
| 4,749,034 | A | 6/1988 | Vandevier et al. | |

(Continued)

FOREIGN PATENT DOCUMENTS

| | | | | |
|---|---|---|---|---|
| WO | 20060096760 | A1 | 5/2006 | |
| WO | WO 2014176225 | A1 * | 10/2014 | E21B 43/128 |
| WO | WO 2014147032 | A9 * | 1/2015 | E21B 34/08 |

OTHER PUBLICATIONS

International Search Report and Written Opinion for related PCT application PCT/US2016/025599 dated Jul. 1, 2016.

*Primary Examiner* — Jennifer H Gay

(74) *Attorney, Agent, or Firm* — Bracewell LLP; James E. Bradley

(57) ABSTRACT

A well pump assembly has a motor operatively connected to a well pump that has an intake. The well pump assembly has a capillary tube that extends alongside the tubing and has an outlet at the well pump assembly. A chemical injection pump is connected to an upper end of the capillary tube adjacent a wellhead of the well. A logic system detects well fluid falling back downward in the tubing and out the intake into the well, and in response turns on the chemical injection pump, which pumps a chemical down the capillary tube into the well adjacent or within the well pump assembly. Once upward flow of well fluid in the tubing has been established, the chemical injection pump may be turned off.

19 Claims, 2 Drawing Sheets

(56) References Cited

U.S. PATENT DOCUMENTS 5,845,709 A 12/1998 Mack et al.
6,190,141 B1* 2/2001 Henry ..... E21B 43/128 166/105
6,684,946 B2 2/2004 Gay et al.
7,708,059 B2 5/2010 Shaw
7,806,186 B2 10/2010 Brown et al.
2006/0011345 A1* 1/2006 Delaloye ..... E21B 37/06 166/304
2006/0096760 A1* 5/2006 Ohmer ..... E21B 43/121 166/304
2008/0179063 A1* 7/2008 Smith ..... E21B 43/122 166/335
2009/0151953 A1* 6/2009 Brown ..... E21B 43/122 166/335
2009/0211753 A1 8/2009 Emtiazian et al.
2009/0250210 A1* 10/2009 Allen ..... E21B 43/128 166/250.15
2012/0093663 A1* 4/2012 Foster ..... F04F 1/08 417/246
2013/0048307 A1* 2/2013 Patel ..... E21B 17/028 166/377
2013/0175030 A1* 7/2013 Ige ..... E21B 43/128 166/250.15
2013/0333893 A1* 12/2013 Morris ..... E21B 43/128 166/312
2015/0007987 A1* 1/2015 Ayres ..... E21B 37/06 166/263
2015/0233530 A1* 8/2015 Sandidge ..... F17D 3/01 166/90.1
2015/0308245 A1* 10/2015 Stewart ..... E21B 47/0007 166/250.01
2015/0369229 A1* 12/2015 Xiao ..... F04B 17/03 417/54
2016/0298631 A1* 10/2016 Reid ..... F04D 15/0077
2016/0333869 A1* 11/2016 Chalifoux ..... F04B 17/03

* cited by examiner

APPARATUS AND METHOD FOR INJECTING A CHEMICAL TO FACILITATE OPERATION OF A SUBMERSIBLE WELL PUMP

FIELD OF THE DISCLOSURE

This disclosure relates in general to submersible well pump assemblies and in particular to injecting a chemical in the event of well fluid flowing back down a tubing string, which, occurs due to shut down of the pump assembly or slowing of the pomp in response to a defection of a gas event.

BACKGROUND

Many hydrocarbon wells are produced by electrical submersible well pump assemblies (ESP). A typical ESP includes a centrifugal pump having a large number of stages, each stage having an impeller and a diffuser. An electrical motor couples to the pump for rotating the impellers. A pressure equalizer or seal section connects to the motor to reduce a pressure deferential between lubricant in the motor and the hydrostatic pressure of the well fluid. Usually, the ESP is suspended on a string of tubing within the well. When operating, the pump discharges well fluid up the string of tubing.

The Well fluid is often a mixture of water, oil and gas. Centrifugal pumps do not operate well when die well fluid produces a large percentage of gas. Sometimes a centrifugal pump can become gas locked and cease to pump well fluid even though the impellers continue to rotate. A gas separator may be employed upstream of the pump to separate at least some gas from the well fluid prior to reaching the pump. The gas separator diverts a portion of separated gas to the annulus surrounding the tubing. The separated gas flows up the annulus and is collected at use well site.

Occasions arise when well fluid flows back down the string of tubing, through the pump and out the pump intake into the well. The well site may lose electrical power to drive the motor, causing this occurrence. An operator may shut down the pump for various reasons, also causing this occurrence. Further, some controllers for ESPs have a feature to break gas locked pumps by rotating the motor and pump in a pumping direction, but at a much slower speed. The slower speed allows well fluid in the tubing to flow downward through the pump in an effort to get the gas within the pump to flow out the pump intake to the tubing annulus.

The downward flow of well fluid through the pump may result in foaming of the well fluid in the annulus surrounding the pump intake and within the interior of the pump. Sometimes, the foam makes it difficult to get the pump to start pumping upward again. The downward flow of well fluid through the pump may also result in sand sliding back down the tubing into the pump. Sand accumulation in the pump is detrimental.

SUMMARY

A method of pumping fluid, from a well includes operatively connecting a motor to a well pump having an intake, defining a well pump assembly, and securing the well pump assembly to a string of tubing. A capillary tube is installed with an outlet at the well pump assembly. The capillary tube extends up the well through a wellhead and to a chemical injection pump located adjacent the wellhead. A controller is electrically connected to the chemical injection pump and to the motor. The controller detects conditions of well fluid falling back downward in the tubing and out the intake into the well, and in response turns on the chemical injection pump, which pumps a chemical, down the capillary tube into the well in or adjacent the well pump assembly. While the pump is operating normally, the chemical injection pump is shut down.

The detection, of well fluid flowing down the tubing may occur in response to a loss in power being supplied by the controller to the motor. The detection of well fluid flowing down the tubing may occur in response to a shut down of the motor by an operator. Also, the detection, of well fluid flowing down the tubing may occur in response to a slowing of a speed of the motor.

In one embodiment, the outlet of the capillary tube is placed exterior of and adjacent the intake of the well pump. In another embodiment, the outlet of the capillary tube is placed within the intake of the well pump. In still another embodiment, the outlet of the capillary tube is located within a discharge of the well pump. If in the discharge of the pump, the chemical injection pump will pump the chemical down the well pump and out the intake of the well pump. The capillary tube may extend, alongside the string of tubing.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore sot to be considered limiting of its scope as the disclosure may admit to other equally effective embodiments.

DETAILED DESCRIPTION OF THE DISCLOSURE

Figure 1:
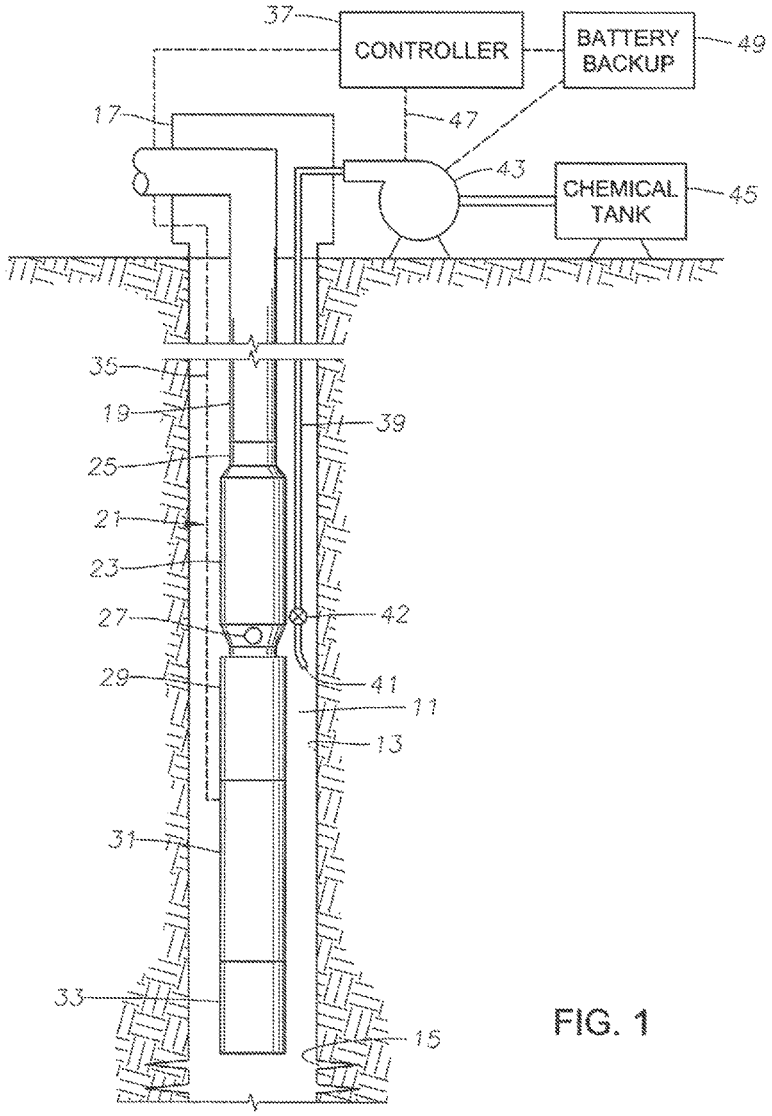
FIG. 1 is a schematic view of an electrical submersible pump assembly with a chemical injection system in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the an. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a well 31 has a casing 13 cemented within. Casing 13 has perforations or other openings 15 to admit well fluid into well 11. A wellhead assembly or production tree 17 locates at the upper end of casing 13. Wellhead assembly 17 supports a string of production tubing 19 extending into well 11.

Tubing 19 supports an electrical submersible pump assembly (ESP) 21, which includes a well fluid pump 23. Pump 23 is rotary pump, normally a centrifugal pump having a large number of stages, each stage comprising an impeller and a diffuser. Pump 23 has a discharge 25 on an upper end, which connects to tubing 19. A pump intake 27 may be located at the lower end of pump 23. If a gas separator (not shown) is employed, the gas separator would connect to the lower end of pump 23, and pump intake 27 would be at the lower end of the gas separator. Other types of pumps rather than centrifugal pumps could be used for well fluid pump 23.

ESP 21 includes a protector, pressure equalizer, or seal section 29. In this example, seal section 29 secures to the lower end of pump intake 27. An electrical motor 31 connects to the lower end of seal section 29. Motor 31 is typically a three-phase motor. Motor 31 rotates a shaft assembly (not shown) that extends through seal section 29 and into pump 23 for rotating the impellers. Motor 31 and seal section 29 contain a motor lubricant, and seal section 29 has a movable element to reduce a pressure differential between the motor lubricant and the hydrostatic pressure of well fluid in well 11. The movable element may be, for example, a flexible bag or a metal bellows.

A gauge unit 33 may be connected to the lower end of motor 31 for measuring parameters such as pressure and temperature. A power cable 35 extends through wellhead assembly 17 and into well 11 alongside tubing 19. Power cable 35 has a motor lead on its lower end that connects to motor 31 to supply electrical power. Signals from gauge unit 33 may be transmitted through power cable 35 to the well site. Other sensors for measuring a variety of parameters could be mounted to ESP 21 or adjacent wellhead assembly 17.

A controller 37 at the well site alongside wellhead assembly 17 provides AC power to power cable 35. Controller 37 may include a variable speed drive unit (VSD) that selectively changes the frequency of the power supplied to vary the speed of rotation of the output, shaft of motor 31. Controller 37 may be powered by various means, including utility transmission lines or an engine operated generator (not shown located at the well site. Normally, the power supplied, to controller 37 will be AC (alternating current) of a fixed frequency.

A capillary tube 39 extends through wellhead assembly 1 and down to ESP 21. Capillary tube 39 may extend alongside tubing 19, and it could be incorporated within power cable 35. Capillary tube 39 has a much smaller diameter than tubing 19; for example, the inner diameter of capillary tube 39 may be about ¼ inch. Capillary tube 39 has an outlet 41, which in this embodiment, is located adjacent pump intake 2 and above seal section 29. Outlet 41 may comprise some type of diffuses or spray head to spray fluid out of capillary tube 39 in a wide pattern.

A valve 42 may be mounted in capillary tube 39 near outlet 11 to block, upward flow of well fluid in capillary tube 39 during the downward flow of well fluid in tubing 19. Valve 42 could be a pressure relief valve, or it could be a valve that selectively allows and blocks both upward and downward flow through, capillary tube 39. An electrical, control, line (not shown) may extend up to controller 3 (FIG. 1) to selectively open and close valve 42. Valve 42 would be closed during normal operation of pump 23. When closed, valve 42 would prevent any downward flowing well fluid in pump 23 from flowing up capillary tube 39.

The upper end of capillary tube 39 connects to a chemical injection pump 43 located at the well she adjacent wellhead assembly 17. Valve 42 is opened when chemical infection pump 43 (FIG. 1) is turned on. Chemical infection pump 43 pumps one or more chemicals supplied from a nearby chemical tank 45. The chemical may be designed to break up gas/water/oil foam that may occur in well 11 surrounding pump intake 27. Various types of chemicals may be employed for this purpose, including isopropyl alcohol.

The chemicals may have other purposes, such as reducing sand damage. A surfactant infected into pump 23 or in the vicinity of ESP 21 may avoid some of the effects of sand accumulation caused by sand draining back down tubing 19 to pump 23 upon shutdown or slowing of pump 23. The surfactant would tend to make the sand slippery and not clump up. The "wetting" of the sand with a surfactant would reduce the abrasiveness of the sand such that the grains would not stick together as much.

An electrical control line 47 extends from chemical injection pump 43 to controller 37. Controller 37 has a logic system that turns on and off chemical injection pump 43 at appropriate times. A backup battery or backup source of power 49 may be connected to the logic system portion of controller 37 and to chemical injection pump 43 to supply power to run chemical injection, pump 43 in the event controller 37 loses power. Backup battery 49 will have the power to run chemical injection pump 43 for a limited time, but will not be able to drive ESP motor 31. Backup battery 49 may supply DC power to chemical injection pump 43, or the logic system in controllers could have an inverter that changes the power being supplied to chemical injection pump 43 to AC.

In operation, controller 37 supplies power to motor 31, causing pump 23 to pump well fluid up tubing 19, in the event of a loss in AC power to controller 37, motor 31 will stop driving pump 23. The well fluid within tubing 19 being pumped to wellhead assembly 27 will begin flowing downward once pump 23 stops. The well fluid flows through pump 23 and out pomp intake 27 into the annulus surrounding pump intake 27. The loss of power is detected by the logic system within controller 37, causing the controller 37 to supply electrical power from battery backup 49 to mm chemical pump 43 on. Chemical pump 43 will pump the chemical from tank 45 down capillary tube 39 for a selected time. The chemical will disperse or liquefy the foam that accumulated around pump intake 27. The chemical may also treat sand accumulation.

When the AC power returns to controller 37, controller 37 will initiate starting of motor 31. Once at operational speed, pump 23 should be able to resume pumping well fluid up tubing 19 due to the break up of foam. Sensors (not shown) may inform the logic system of controller 37 once a desired flow rate of well fluid out of wellhead assembly 17 has been achieved. The logic system then turn off chemical injection pump 43 unless its has already been turned off. To preserve the chemical in chemical tank 45, preferable chemical injection pump 43 operates a limited time only when motor 31 has been shut down, plus possibly a short time thereafter during start up.

The same steps will occur if an operator deliberately shuts down motor 31, unless the operator chooses to manually keep chemical injection pump 43 shut down. If needed, during a later startup, the operator could manually turn chemical injection pump 43 on for a selected time.

Controller 37 may have features to detect gas locking and in response to greatly slow down the speed of motor 31. If so, the slow speed of motor 31 may result in well fluid flowing back downward through tubing 19 and pump 23 out pump intake 27. The logic system of controller 37 may start chemical injection pump 43 when it detects the slowing down of motor 31. Chemical injection pump 43 would then pump chemicals down capillary tube 39 to disperse in the vicinity of pump intake 27. Once controller 37 begins to increase the speed of motor 31, pump 23 will again begin pumping well fluid up tubing 19. Controller 37 then shuts off chemical injection pump 43, unless it has already been shut down due to reaching a run lime limit. The introduction of the foam breaking chemical reduces foam that may have occurred due to the downward flow of well fluid through pump 23. If the chemical also includes a surfactant, it will reduce the detrimental effects of sand accumulation occurring due to sand falling back down tubing 19.

Figure 2:
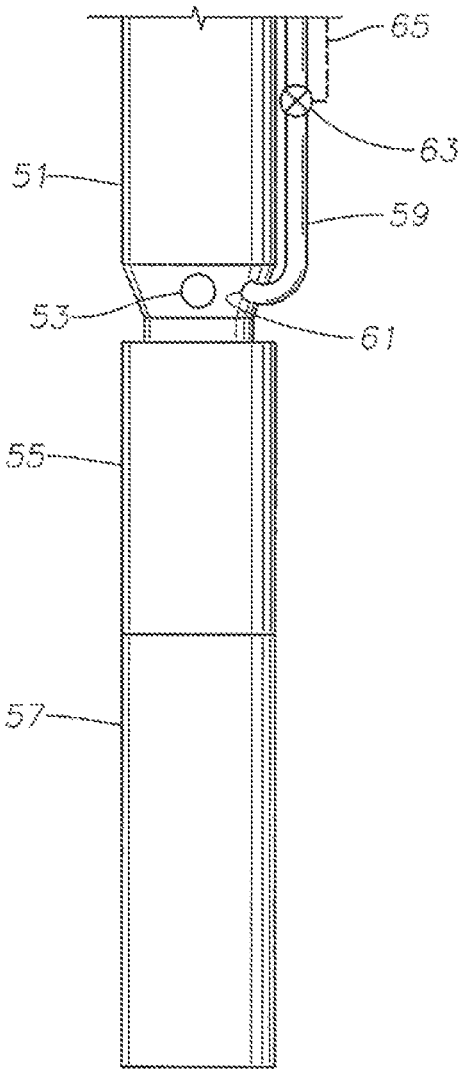
FIG. 2 is a schematic view of an alternate embodiment of the chemical injection system, of FIG. 1.

In the embodiment of FIG. 2, the same equipment, at the web she shown in FIG. 1 may be used. Pump 51, pump intake 53, seal, section 55, and motor 57 may be the same as in the first embodiment. Capillary tube 59 has its outlet 61 located within the interior of pump 51 which in this embodiment is within pump intake 53, rather than on the exterior as in FIG. 1.

A valve 63 may be mounted in capillary tube 59 near outlet 61 to block upward flow of well fluid in capillary tube 59 during the downward flow of well fluid in tubing 19 (FIG. 1). Valve 63 could be a pressure relief valve, or it could be a valve that selectively allows and blocks both upward and downward flow through capillary tube 59. In this embodiment, so electrical control line 65 extends up to controller 37 (FIG. 1) to selectively open and close valve 63. Valve 53 would be closed during normal, operation of pump 51. When closed, valve 63 would prevent any downward flowing well fluid in pump 51 from flowing up capillary tube 59. Valve 63 is opened when chemical injection pump 43 (FIG. 1) is turned on. The embodiment of FIG. 2 operates in the same manner as in FIG. 1, other than the opening and closing of valve 63.

Figure 3:
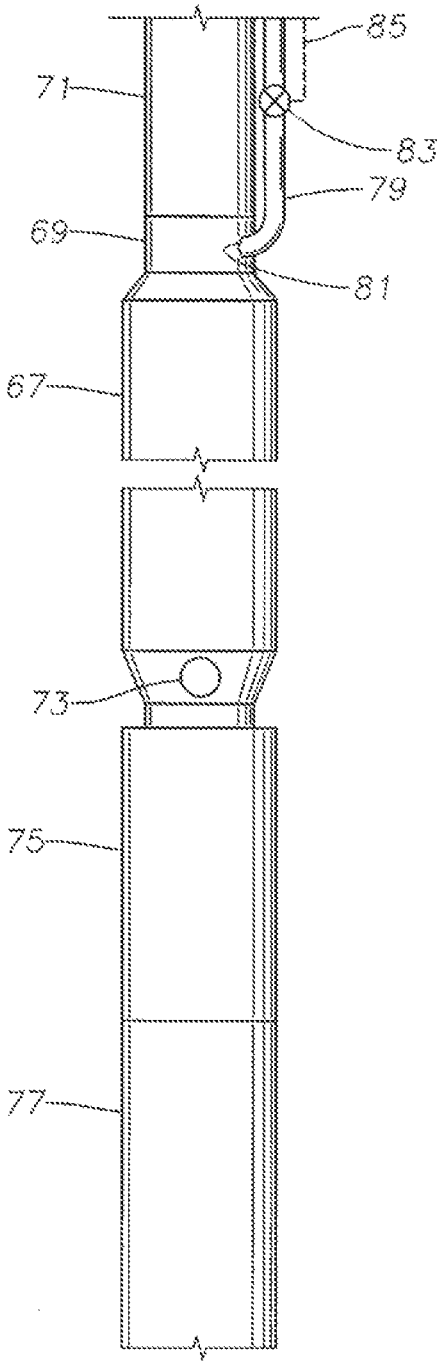
FIG. 3 is a schematic view of another alternate embodiment of the chemical injection, system of FIG. 1.

In the embodiment of FIG. 3, the same equipment at the well site shown in FIG. 1 may be used. Pump 67 is the same as in the other embodiments and has a discharge 69 connected to the lower end of tubing 71. Pump intake 73, seal section 15 and motor 77 are the same as in FIG. 1. In this embodiment, capillary tube 79 has an outlet 81 within the interior of pump 67, specifically within pump discharge 69. A valve 83 blocks upward flow through capillary tube 85. Valve 83 may be controlled with controller 37 (FIG. 1) via an electrical control line 85. Valve 83 is open when chemical injection pump 43 (FIG. 1) is operating and otherwise closed.

The embodiment of FIG. 3 operates in the same manner as the embodiment of FIG. 2. When chemical injection pump 43 (FIG. 1) is operating, the chemicals will be pumped down capillary tube 79, into pump discharge 69, down pump 67 and out pump intake 73.

While the disclosure has been described in only a few of its forms, it should be apparent to those skilled in the art that various changes may be made.

The invention claimed is:

1. A method of pumping fluid from a well, comprising the following steps:

(a) operatively connecting a well pump assembly to a string of tubing, the well pump assembly comprising a motor connected to a centrifugal well pump having an intake and stages, each of the stages having an impeller and a diffuser;

(b) deploying the well pump assembly and capillary tube through a wellhead into the well, the capillary tube provided with an outlet at the well pump assembly;

(c) connecting a chemical injection pump to an upper end of the capillary tube adjacent the wellhead;

(d) electrically connecting a controller to the chemical injection pump and to the motor;

(e) supplying power to the motor with the controller to rotate the impellers of the well pump in a forward direction, and with the well pump, drawing well fluid into the intake and pumping the well fluid in an upward direction through the tubing to the wellhead; and (f) slowing the rotation of the impellers in the forward direction sufficiently to cause well fluid to fall back downward in the tubing through the stages and out the intake into the well, and while the well fluid is still falling back downward in the tubing, turning on the chemical injection pump with the controller and pumping a chemical down the capillary tube into the well in or adjacent the well pump assembly.

2. The method according to claim 1, wherein:

slowing the rotation of the impellers in step (f) occurs in response to a loss in power being supplied by the controller to the motor.

3. The method according to claim 1, wherein:

slowing the rotation of the impellers in step (f) is made by the controller in response to a detection of the presence of a gas content in the stages above a minimum level; and after the gas content in the stages decreases below the minimum level, increasing the speed of rotation of the impellers to again pump the well fluid up the tubing, and turning off the injection pump.

4. The method according to claim 1, wherein step (b) further comprises:

placing the outlet of the capillary tube exterior of and adjacent the intake of the well pump.

5. The method according to claim 1, wherein step (b) further comprises:

placing the outlet of the capillary tube within the intake of the well pump.

6. The method according to claim 1, wherein:

step (b) further comprises placing the outlet of the capillary tube within a discharge of the well pump; and step (f) further comprises with the chemical injection pump, pumping the chemical down the well pump and out the intake of the well pump as the well fluid falls downward in the well pump.

7. The method according to claim 1, wherein:

the chemical injected in step (f) comprises a foam breaking chemical.

8. The method according to claim 1, wherein:

the chemical injected in step (f) comprises a surfactant.

9. The method according to claim 1, further comprising:

after step (f), again rotating the impellers in a forward direction at a sufficient speed to cause well fluid mixed with the chemical to flow up the tubing.

10. A method of pumping fluid from a well having a well pump assembly suspended on a string of tubing in the well, the well pump assembly having a motor operatively connected to a centrifugal well pump that has an intake and a plurality of stages, each of the stages comprising an impeller and a diffuser, the method comprising the following steps:

(a) providing the well pump assembly with a capillary tube that extends alongside the tubing and has an outlet at the well pump assembly;

(c) connecting a chemical injection pump to an upper end of the capillary tube adjacent a wellhead of the well;

(d) supplying power to the motor to rotate the impellers of the well pump in a forward direction, and with the well pump, drawing well fluid into the intake and pumping the well fluid upward through the tubing to the wellhead;

(e) detecting a gas content in the stages above a selected level, and in response, slowing a rotational speed of the impellers in the forward direction sufficiently to cause well fluid to fall back downward in the tubing, through the stages, and out the intake into the well, and turning on the chemical injection pump and pumping a chemical down the capillary tube in or adjacent the well pump assembly while the well fluid continues to fall back downward; then (f) increasing the rotational speed of the impellers in the forward direction sufficiently to cause the well pump to pump the well fluid mixed with the chemical through the well pump and up the tubing.

11. The method according to claim 10, wherein:

the chemical in step (e) comprises a foam breaking chemical.

12. The method according to claim 10, wherein:

the chemical in step (e) comprises a surfactant.

13. The method according to claim 10, wherein:

step (a) further comprises mounting a valve in the capillary tube adjacent the outlet;

step (d) further comprises closing the valve; and step (e) further comprises opening the valve.

14. The method according to claim 10, wherein:

step (a) further comprises placing the outlet of the capillary tube exterior of and adjacent the intake of the well pump.

15. The method according to claim 10, wherein:

step (a) further comprises placing the outlet of the capillary tube within the intake of the well pump.

16. The method according to claim 10, wherein:

step (a) further comprises placing the outlet of the capillary tube within a discharge of the well pump; and step (e) further comprises with the chemical injection pump, pumping the chemical down the well pump and out the intake of the well pump while the impellers continue to rotate in the forward direction and the well fluid continues to fall downward in the tubing.

17. A method of pumping fluid from a well, comprising the following steps:

(a) operatively connecting a well pump assembly to a string of tubing, the well pump assembly comprising a motor connected to a centrifugal well pump having an intake and stages, each of the stages having an impeller and a diffuser;

(b) deploying the well pump assembly and a capillary tube through a wellhead into the well, the capillary tube provided with an outlet at the well pump assembly;

(c) connecting a chemical injection pump to an upper end of the capillary tube adjacent the wellhead;

(d) electrically connecting a controller to the chemical injection pump and to the motor;

(e) supplying power to the motor with the controller to rotate the impellers of the well pump in a forward direction, and with the well pump, drawing well fluid into the intake and pumping the well fluid in an upward direction through the tubing to the wellhead;

(f) detecting a loss in power to the motor, which causes well fluid to flow back downward in the tubing through the stages and out the intake into the well; and (g) while the well fluid is still flowing back downward in the tubing, turning on the chemical injection pump with the controller and pumping a chemical down the capillary tube into the well in or adjacent the well pump assembly.

18. The method according to claim 17, wherein the impellers continue to rotate in the forward direction during step (g).

19. The method according to claim 17, wherein step (g) further comprises:

injecting the chemicals into the discharge of the well pump and mixing the chemicals with the well fluid flowing back downward through the stages.

* * * * *